US010753079B2

(12) United States Patent
Rulquin et al.

(10) Patent No.: US 10,753,079 B2
(45) Date of Patent: Aug. 25, 2020

(54) COLLAPSIBLE POP-UP STRUCTURE FOR THE RAPID ERECTION OF SHELTERS

(71) Applicants: UTILIS, Ennery (FR); LOCABOXE, Ligneville (FR)

(72) Inventors: Fabien Rulquin, Remereville (FR); Sébastien Sibeud, Metz (FR)

(73) Assignees: SARL LOCABOXE, Ligneville (FR); UTILIS SAS, Ennery (FR)

( * ) Notice: Subject to any disclaimer, the term of this patent is extended or adjusted under 35 U.S.C. 154(b) by 0 days.

(21) Appl. No.: 16/308,004

(22) PCT Filed: Jun. 6, 2017

(86) PCT No.: PCT/EP2017/063720
§ 371 (c)(1),
(2) Date: Dec. 7, 2018

(87) PCT Pub. No.: WO2017/211833
PCT Pub. Date: Dec. 14, 2017

(65) Prior Publication Data

US 2019/0257072 A1 Aug. 22, 2019

(30) Foreign Application Priority Data

Jun. 8, 2016 (FR) ..... 16 55265

(51) Int. Cl.
*E04B 1/344* (2006.01)
*E04B 1/343* (2006.01)

(52) U.S. Cl.
CPC ..... *E04B 1/3445* (2013.01); *E04B 1/3431* (2013.01); *E04B 1/34384* (2013.01); *E04B 2001/34394* (2013.01)

(58) Field of Classification Search
CPC ..... E04B 1/3431; E04B 1/3445; E04B 1/344; E04B 1/34384; E04B 1/3442; E04B 2001/34394; E04B 7/166
See application file for complete search history.

(56) References Cited

U.S. PATENT DOCUMENTS 2,098,469 A * 11/1937 Smith ..... A47D 13/065 52/66
5,765,316 A * 6/1998 Kavarsky ..... E04B 1/3442 52/143

(Continued)

FOREIGN PATENT DOCUMENTS

CA 2816622 A1 * 5/2012 ..... E04B 1/344
EP 2535470 A1 * 12/2012 ..... E04B 1/24

(Continued)

OTHER PUBLICATIONS

Int'l Search Report and Written Opinion issued in App. No. PCT/EP2017/063720 (2017).

*Primary Examiner* — Christine T Cajilig
(74) *Attorney, Agent, or Firm* — Barnes & Thornburg LLP

(57) ABSTRACT

A collapsible pop-up structure for the rapid erection of buildings includes at least two portals forming two first parallel aspect facades of the shelter, the two other facades each comprising means for vertical articulation, on one hand with respect to the uprights of the portals that they connect, and on the other hand with respect to an axis positioned centrally between the portals. The portals are independent and the uprights of one portal each comprise an internal profile that can be made to slide so as to increase the height thereof in order to impart pitch to the roof, wherein said internal profiles are connected by an upper beam and form (Continued)

a secondary upper portal that can be made to slide into the portal. Means for controlling the sliding are provided in at least one of the uprights.

16 Claims, 3 Drawing Sheets

(56) References Cited

U.S. PATENT DOCUMENTS

| | | | | |
|---|---|---|---|---|
| 6,227,397 | B1 * | 5/2001 | Kim | B65D 88/005 220/1.5 |
| 9,067,721 | B2 * | 6/2015 | Mullaney | E04B 1/3431 |
| 2006/0248809 | A1 * | 11/2006 | Rulquin | E04B 1/3445 52/79.5 |
| 2009/0014044 | A1 * | 1/2009 | Hartman | E04B 1/3445 135/143 |
| 2011/0023925 | A1 * | 2/2011 | Johnson | B60P 3/341 135/139 |
| 2012/0317898 | A1 * | 12/2012 | Strachan | E04B 1/3445 52/79.5 |

FOREIGN PATENT DOCUMENTS

| | | |
|---|---|---|
| FR | 2850408 | 7/2004 |
| JP | S47-14808 U | 10/1972 |

* cited by examiner

COLLAPSIBLE POP-UP STRUCTURE FOR THE RAPID ERECTION OF SHELTERS

CROSS-REFERENCE TO RELATED APPLICATIONS

This patent application is a U.S. nationalization under 35 U.S.C. § 371 of International Application No. PCT/EP2017/063720, filed Jun. 6, 2017, the disclosure of which is incorporated herein by reference in its entirety. This application also claims priority to French Patent Application No. 1655265, filed Jun. 8, 2016, the disclosure of which is incorporated herein by reference in its entirety.

FIELD OF THE DISCLOSURE

Embodiments of the present disclosure find application in the field of modular buildings which can be deployed rapidly comprising in particular a structure covered with a waterproof flexible material and/or components made of rigid material.

BACKGROUND

Temporary shelters are being used more and more due to their increasingly frequent use on a planetary scale on temporary sites. The current phenomenon of migrants for example requires such deployment in, in principle, temporary camps set up along the border of territories that they are seeking to enter. The world's conflict zones can additionally create a need for the setting up of accommodation facilities as a result of population displacement. The management of people who are homeless can also result from natural disasters such as earthquakes or eruptions, sometimes imposing massive population displacements.

In all these circumstances, just as much as in the case of theaters of humanitarian or military operations there is an emerging need, apart from housing, for provisional functional installations. The corresponding shelters or structures (field hospitals, military installations and the like) are in principle not intended to last, and are there to cater for urgent but specific situations.

One example of an erectable structure is shown, for example, in U.S. Pat. No. 7,475,514, in a configuration provided in particular for accommodating horses for the duration of equestrian events. A lifting bar connected by several wires to the structure is used during erection of the structure and is almost essential to perform these operations, among other disadvantages.

Another example is shown in US patent application 2014/0311053 which discloses a collapsible shelter with a sloping roof having a predetermined fixed slope, that is to say non-adjustable, among other disadvantages.

This background information is included to provide some information believed by the applicant to be of possible relevance to the present disclosure. No admission is intended, nor is such an admission to be inferred or construed, that any of the preceding information constitutes prior art against the present disclosure.

SUMMARY

In one embodiment, a foldable and unfoldable structure for rapid erection of building in accordance with the present disclosure includes at least two portal frames constituting two generally parallel first sidewalls of the building, each one of two other sidewalls having means for vertical hinging relative, firstly, to uprights of the portal frames that they connect and, secondly, about an axis located centrally between the portal frames. It will be evident that the said articulations are there to allow the structure to be folded about itself, notably for transporting or storing it, and then for deploying it on-site in a few minutes. It is then covered with rigid and/or flexible material secured to at least one frame of the structure, said materials being associated with each one of front, rear and lateral sidewalls, a floor and a roof of the shelter once erected.

In accordance with another embodiment of the present disclosure, the portal frames are independent and the uprights of a portal frame each include a telescopically sliding inner profiled member for increasing the height thereof in order to give inclination to the roof, said inner profiled members being connected by an upper spar member and forming an upper secondary portal frame which is slidable within a said portal frame, sliding control means being provided in at least one of the uprights thereof.

Apart from the fact of considerably increasing the useful volume of the shelter coupled with optimization of the interior space, the configuration of disclosed embodiments is particularly suited to cold and rainy climates, since the possibility of deploying a sloping roof ensures good conditions for the evacuation of rainwater. This characteristic has a technical effect on the watertightness of the structure, and consequently on its immediate functional efficiency, giving a better guarantee than that of flat roof structures. The roof, which runs the entire length of the structure, further resists snow and the fact that it is sloping allows it to slide off, providing another substantial technical advantage of embodiments of the present disclosure, that of not having to take account of snow in the calculations.

In some embodiments, the roof is adjustable and can be set flat or be raised. Such flexibility is another advantage of the system.

The shelter according to embodiments of the present disclosure includes three generally parallel portal frames: a central portal frame fitted with a secondary sliding portal frame and two portal frames defining parallel front and rear walls of the shelter, once in an erected position. This symmetrical structure provides maximum useful area for a much reduced erection time.

In some embodiments, each portal frame includes a lower longitudinal member connecting the lower ends of the uprights, transforming the structure into a framework that increases overall rigidity which can facilitate erection/refolding operations. These longitudinal members also support the floor of rigid panels insulating the occupants from the ground. They additionally avoid using supplementary means for chocking up the floor elements from below.

In some embodiments, depending on the number of portal frames, at least one floor can be hinged relative to, firstly, a lower longitudinal member of one of two portal frames connected by said floor and secondly a horizontal axis centrally located between portal frames when the floor is deployed.

According to an embodiment of the present disclosure, the inner profiled member of the upright of the portal frame provided with control means includes a rack gear adapted to cooperate with a pinion. To make for easy operation by the user, the shaft of the pinion can be accessed from outside of said upright directly or via a bevel gear device. The control of the pinion is accessible from outside or from inside the building.

In some embodiments, one end of said shaft or a coupling of the bevel gear device can be configured to be hollow, the shape of the recess then being adapted to accommodate one end of a manual or automated rotating tool. This can typically be a crank handle or a rotary tool such as a heavy duty drill with an end piece adapted to fit into the recess.

According to an embodiment of the present disclosure, one of the walls of the profiled member that slides in an upright can be provided with aligned apertures forming the steps of the rack. Other conventional rack designs are of course possible. Alternatively, the control can of course be motorized.

In some embodiments, rigid and flexible coverings are used with the unfoldable and foldable structures of the present disclosure. The sidewalls and the floor are provided with solid panels, so that the roof can be made of a flexible material such as a canvas-like material. The material in question can be put into position even before the secondary portal frame is deployed, the soft texture thereof allowing it to adapt to the process of erection. According to one possibility, the canvas-like material is advantageously watertight.

In some embodiments, the coverings of the walls, notably external but also the internal walls, for example to divide a shelter into two spaces, comprise at least one skin, ideally up to three skins, giving them properties of far greater insulation compared to those of a flexible material like fabric. The fact of having more layers or skins allows air gaps to be established therebetween, which increases and improves very substantially the building's insulation. Here, the term skin means a flexible or rigid material which is fixed to the structure and which provides, firstly, protection in the form of a covering, and, secondly, protection against the elements, so that objects and people who are inside the building are adequately protected, for instance against bad weather.

In some embodiments, the structural elements of the structure are of aluminum. The portal frame sidewalls can, in the structure of disclosed embodiments, be fully open, that is to say devoid of reinforcement in the form of posts, said portal frame providing sufficient stability to the structure. The lightness provided by this material provides in addition a considerable advantage during erection/folding up of the shelter, simple manual operations performed by a single individual being sufficient in this respect. According to an additional characteristic, the structural members include at least one longitudinal slot, often several, which allow simple and weathertight securing of certain coverings, such as soft coverings.

To make the structure easily transportable, provision is further advantageously made for the length of the portal frames assembled in the folded position to be less than the length of standard containers, notably 20 foot sea containers in disclosed embodiments. Other lengths are possible, depending on the type of packaging.

This ensures that a certain number of structures in the folded state can be placed in a single container, the standardized width of which is much greater than that of said folded structure.

Embodiments of the present disclosure concern buildings for housing and provisional functional installations such as field hospitals, military installations, dining rooms, kitchens, washrooms etc.

Embodiments of the present disclosure allow for speedy mounting/taking down during the erection of functional shelters in the shortest possible time. In other words, disclosed embodiments are especially adaptable to constraints which could possibly be found on a site where they are being installed, such as climatic conditions.

DETAILED DESCRIPTION OF EMBODIMENTS

Figure 1:
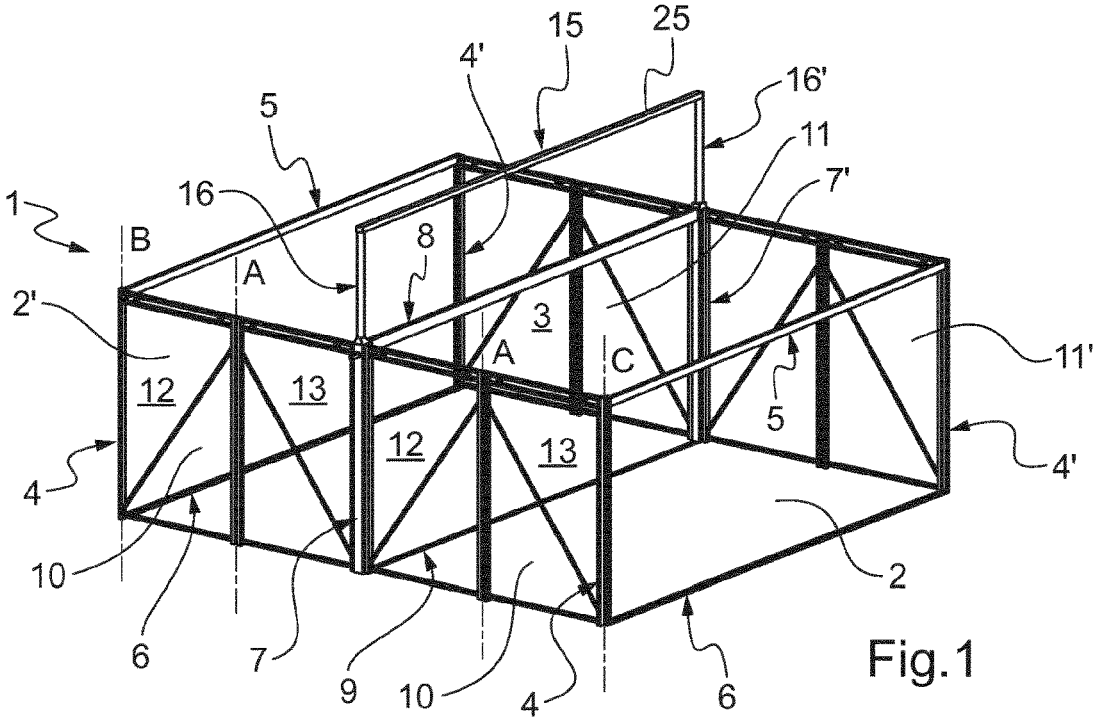
FIG. 1 shows, in perspective view a structure according to the present disclosure in the unfolded position with a secondary roof ridge-forming portal frame deployed.
Figure 2:
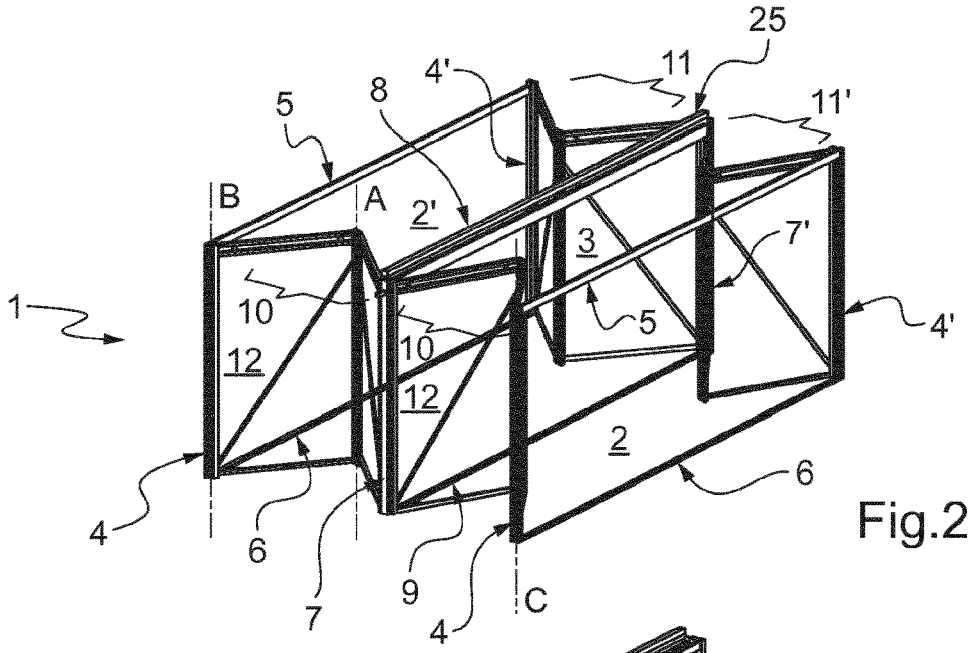
FIG. 2 shows, in perspective, an intermediate step in the folding or unfolding operation with the secondary roof ridge-forming portal frame retracted.

Referring to FIGS. 1 and 2, the structure of the building according to the present disclosure includes two portal frames or frames 2, 2' located at one and the other side of a central portal frame or frame 3. Said portal frames 2, 2' each include uprights 4, 4' and an upper spar member 5 and a lower longitudinal member 6, making up a frame of rectangular shape. The central portal frame similarly includes uprights 7, 7' and an upper spar member 8, and a lower longitudinal member 9 creating a rigid frame of substantially the same shape and area as the portal frames 2, 2'.

Semi-sidewalls 10, 10', 11, 11' arranged symmetrically relative to central portal frame 3, are foldable relative to said portal frame 3, to one of the portal frames 2, 2' and finally to a hinging axis A which is central with respect to them. These semi-sidewalls 10, 10' are in practice each constituted by two frame structures 12, 13 (only one side carries reference numerals but they are present on both sides completely symmetrically) that can be hinged relative to one another about a vertical axis A, hinged with respect to portal frame 2 about a vertical axis B and with respect to portal frame 2' about an axis C.

A secondary portal frame 15, visible as deployed in FIG. 1, is telescopically slidable relative to the central portal frame 3. In FIG. 2 it is retracted and barely visible. It includes lateral uprights 16, 16' at least one of which is in reality a profiled member (see FIGS. 5 and 6) configured to telescopically slide and be driven through a conventional rack and pinion system, and an upper spar member 25.

Figure 3:
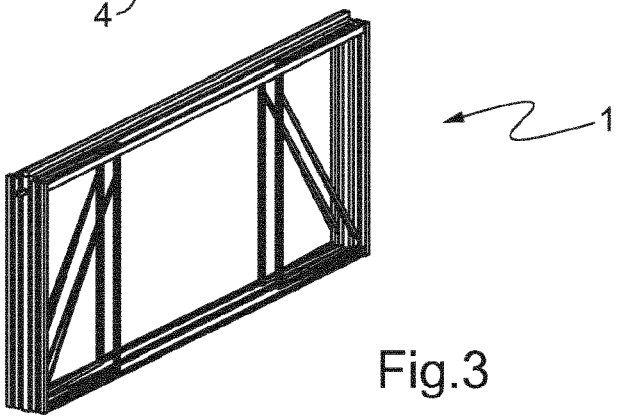
FIG. 3 shows the completely folded structure.

FIG. 3 shows the structure 1 of the two previous figures fully collapsed, substantially flattened. It is in this configuration that it is transported typically using standard containers. Unfolding and folding thereof, including an intermediate stage visible in FIG. 2, are easy since the structure is light, due to the use of aluminum or alternatively a composite material, and can easily be handled by a single person.

Figure 4:
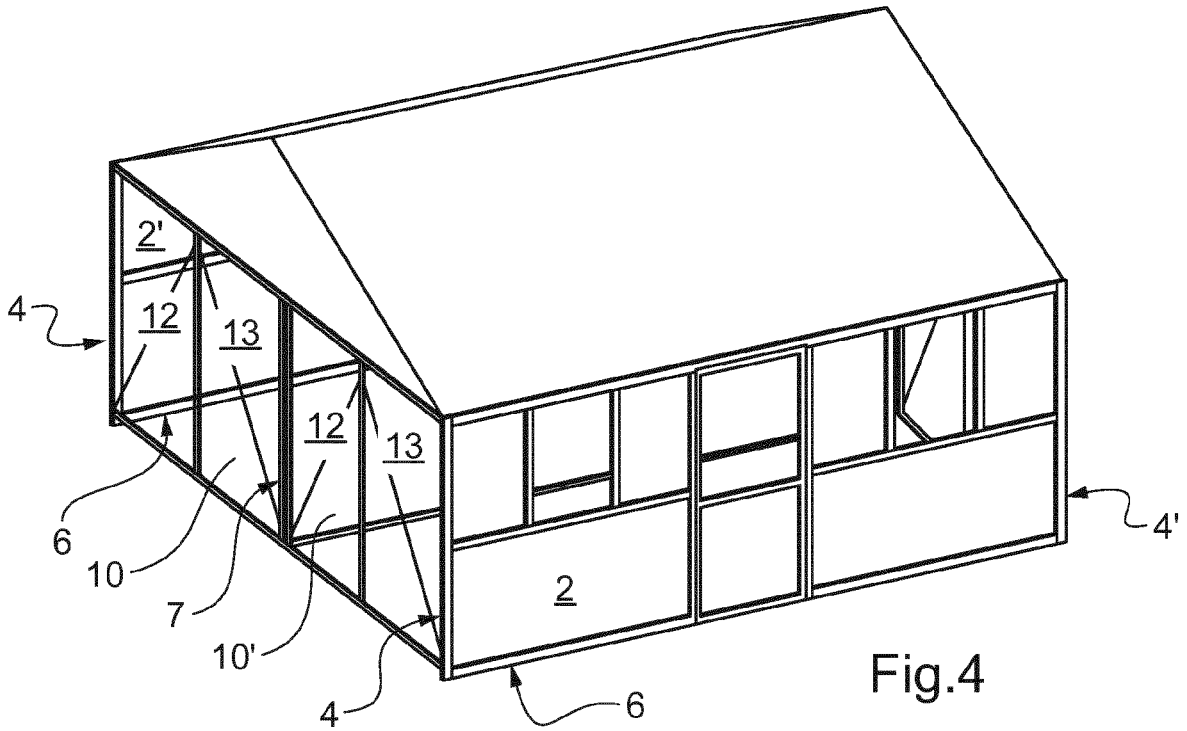
FIG. 4 shows a shelter partially covered with panels/roofing material.

FIG. 4 shows a structure like the one in FIGS. 1 to 3 partially covered with rigid panels, or more generally of a rigid material and/or flexible material. In this particular case, front sidewall 2 is covered with rigid panels with provision for openings for two windows and a door. The roof is covered using a flexible material which can adapt to the particular shape resulting from raising the secondary portal frame 15, upper spar member 25 forming the ridge of the building's roof. Alternatively, the material can conform to a flat roof configuration, when secondary portal frame 15 is not deployed. Sidewall 2' corresponding to the portal frame is also covered with panels. Lateral sidewalls 10, 10' are shown not covered with any panel, particularly to aid description and better illustrate how those covering the other walls are arranged.

Figure 5:
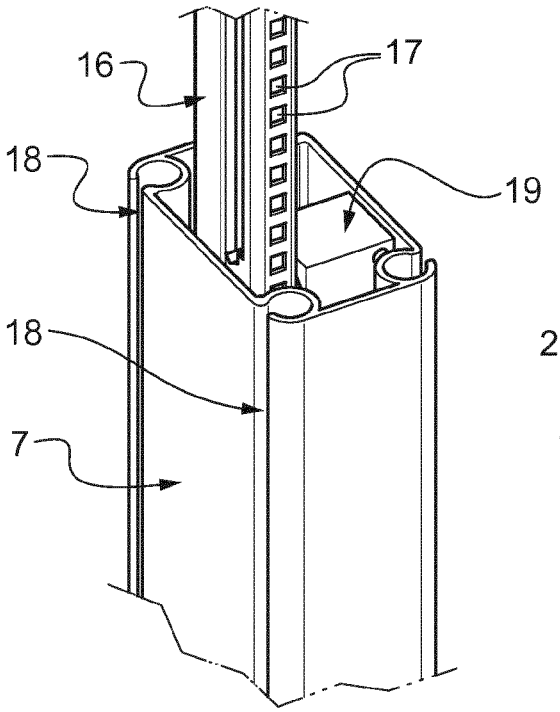
FIG. 5 shows in perspective a portion of an upright fitted with a rack for deploying the secondary portal frame for forming a roof ridge.
Figure 6:
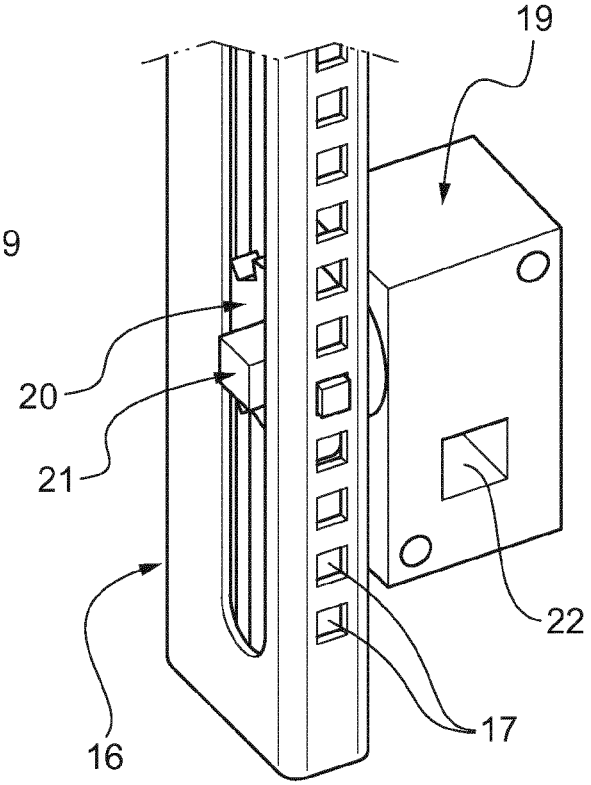
FIG. 6 shows a portion of the rack extracted from its upright.

FIGS. 5 and 6 show a non-limiting implementation of a rack, in which profiled member 16 sliding in the upright 7 of central portal frame 3 includes steps in the form of apertures of rack 17, regularly formed in a wall thereof. It will be noted that the transverse dimensions of profiled member 16 enable it to move inside upright 7, the remaining space being made use of for its motion control system (see FIG. 6). Longitudinal slotted cylindrical channels 18 at corners of upright 7 are used to secure the panels e.g. of canvas material. A bevel gear system 19 is provided to cooperate with profiled member 16 for controlling its displacement.

Thus, as is apparent in FIG. 6, the square apertures constituting a rack 17 of profiled member 16 cooperate with a pinion 20 the peripheral teeth of which are shaped to engage with the apertures of rack 17. A spigot 21 is also provided to assist in translational guiding of profiled member 16 relative to bevel gear system 19 fixed to inside of upright 7. When the pinion 20 is driven in rotation, meshing of the periphery of the pinion with the apertures of rack 17 causes displacement of profiled member 16 in a direction parallel to an axis of upright 7.

The recess 22 of prismatic shape of bevel gear system 19 is in addition accessible from outside of upright 7, and is used to control the rotation of pinion 20, in turn driving the profiled member 16 and the secondary portal frame 15 as described above.

Figure 7:
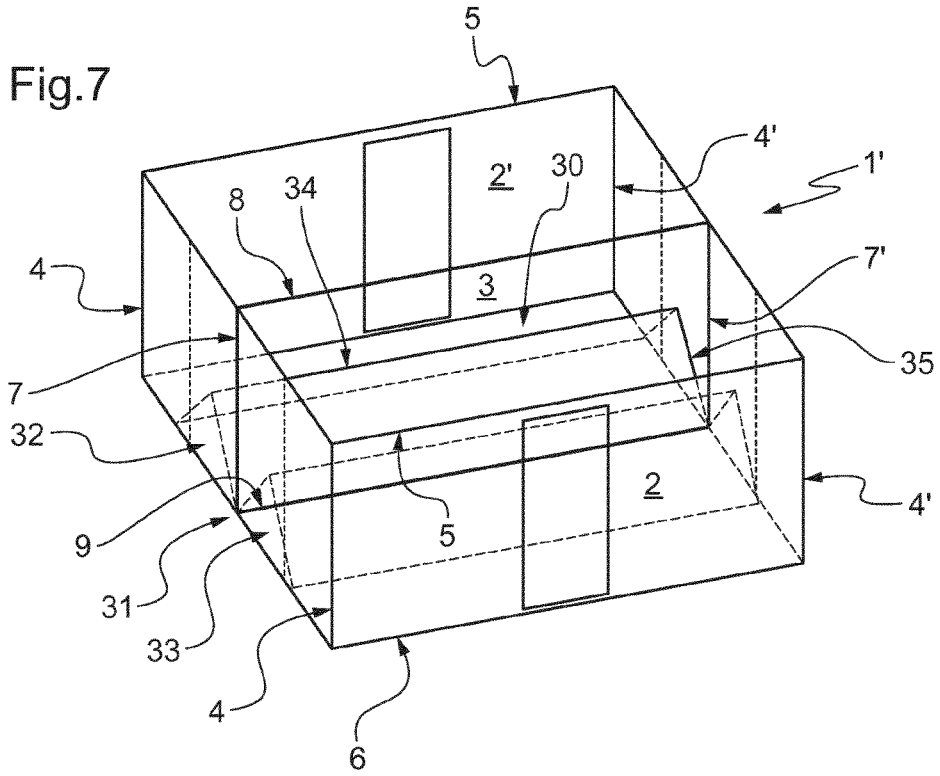
FIGS. 7 and 8 schematically show the operation of the floor which can be unfolded or folded up at the same time as the rest of the structure.
Figure 8:
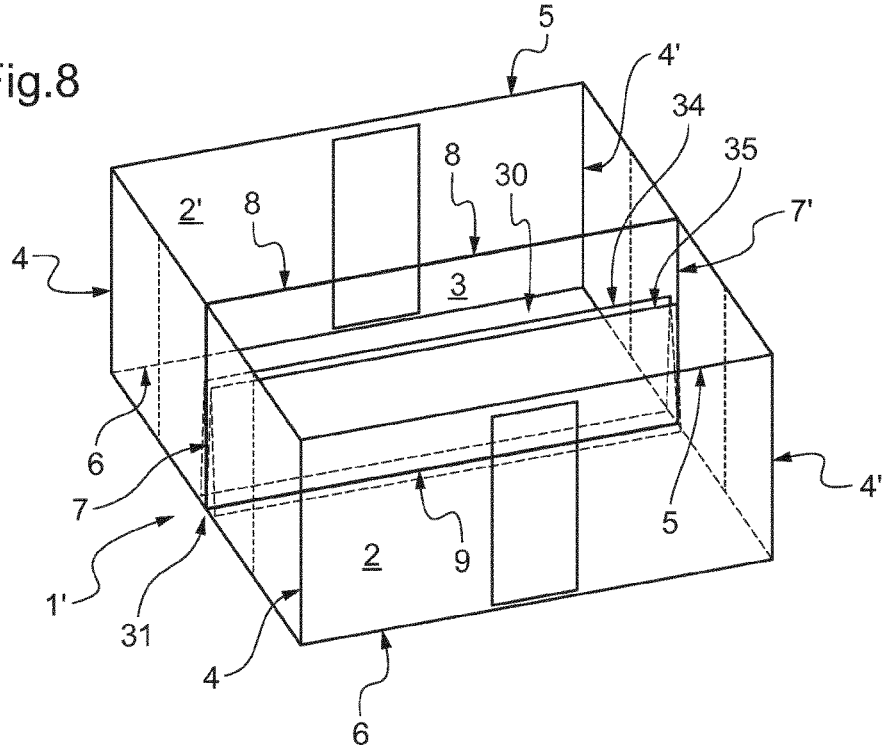

FIGS. 7 and 8 show a floor 30 in a partially unfolded/folded position (FIG. 7) and in its fully folded-up position (FIG. 8). These drawings are intended to better illustrate the operation of floor 30, and that is why they are not visible in the rest of the structure 1, but rather in a structure 1' showing this schematically without unnecessary detail which could hide certain parts and interfere with the understanding of the unfolding/folding-up operation of the floor. The floor 30 includes a central hinge joint 31 cooperating actually with lower longitudinal member 9 of the central portal frame 3, and hinge joints 34, 35 centrally placed at semi-portions 32, 33 of the floor in a structure having three portal frames such as that illustrated in the drawings. The semi-portions 32, 33 of the floor are folded up against a portal frame prior to folding up the remainder of the structure 1, 1', and are unfolded following erection thereof, coming to bear against the lower longitudinal members 6 of portal frame 2, 2'. The axes of all the latter hinge joints are horizontal.

The rapid erection and folding of the structure, including its floor and its roof, result in particular from the overall design discussed above. This original design adapts in every case to all applications requiring the erection of a temporary structure, not only where it is a matter of emergency as discussed above, but also for example in the world of entertainment (marquees and the like).

The present disclosure is not limited to the examples described and explained with reference to the drawings, but encompasses variants and versions notably of shape and materials which fall within the scope of the claims, such as regarding the steps in the rack or the driving pinion.

The invention claimed is:

1. A foldable and unfoldable structure for the rapid erection of buildings or shelters, the structure comprising:

at least two first portal frames defining two substantially parallel first sidewalls, each one of two second sidewalls having means for vertical hinging relative to uprights of the first portal frames that they connect and about an axis located between the first portal frames, the structure being covered with rigid and/or flexible covering materials secured to the structure, wherein the first portal frames are independent relative to a second portal frame and uprights of the second portal frame each have an inner telescopically sliding profiled member for extending a height thereof for the purpose of giving an inclination to a roof, the inner telescopically sliding profiled members being connected by an upper spar member thereby forming an upper third portal frame which is telescopically slidable within the second portal frame, and means for controlling sliding of the third portal frame being provided in at least one of the uprights of the second portal frame.

2. The foldable and unfoldable structure of claim 1, wherein the second portal frame provided with the third portal frame is central to the first portal frames in a deployed position.

3. The foldable and unfoldable structure of claim 1, wherein each of the first and second portal frames includes a lower longitudinal member connecting lower ends of the uprights thereof.

4. The foldable and unfoldable structure of claim 3, further comprising at least one floor which is hinged relative to the lower longitudinal member of at least one of the first and second portal frames which are connected by the floor and relative to a horizontal axis located centrally between the connected portal frames when the floor is deployed.

5. The foldable and unfoldable structure of claim 1, wherein the control means includes a rack adapted to cooperate with a pinion.

6. The foldable and unfoldable structure of claim 5, wherein a shaft of the pinion is accessible from outside of the upright directly or via a bevel gear device.

7. The foldable and unfoldable structure of claim 6, wherein one end of the shaft or a driven end of the bevel gear device is hollow, the shape of the hollow being adapted for accommodating one end of a rotatable manual or automated tool.

8. The foldable and unfoldable structure of claim 5, wherein at least one of the profiled members is provided with aligned apertures forming steps of the rack.

9. The foldable and unfoldable structure of claim 1, wherein the covering materials include solid panels fitted with the sidewalls and a floor, and a canvas cover for the roof.

10. The foldable and unfoldable structure of claim 9, wherein the solid panels fitted with the sidewalls are rigid and comprise at least one skin.

11. The foldable and unfoldable structure of claim 1, wherein the first, second, and third portal frames are formed of aluminum.

12. The foldable and unfoldable structure of claim 1, further comprising at least one longitudinal slot for securing the covering materials.

13. A foldable and unfoldable structure for the rapid erection of buildings or shelters, the structure comprising:

a central portal frame;

a first outer portal frame and a second outer portal frame positioned on opposing sides of the central portal frame;

a first pair of folding semi-sidewalls coupled between the central portal frame and the first outer portal frame;

a second pair of folding semi-sidewalls coupled between the central portal frame and the second outer portal frame;

a sliding portal frame coupled to the central portal frame; and a flexible roof covering coupled between the first and second outer portal frames, wherein the structure is movable between a collapsed position where the first and second outer portal frames are adjacent to the central portal frame and the sliding portal frame is in a lowered position substantially aligned with the central portal frame and an erected position where the first and second outer portal frames are spaced apart from the central portal frame and the sliding portal frame is in a raised position extending upward from the central portal frame, the first and second pairs of semi-sidewalls are configured to expand and collapse with movement of the first and second outer portal frames.

14. The foldable and unfoldable structure of claim 13, further comprising a foldable floor extending between the first and second outer portal frames, wherein the floor is configured to expand and collapse with movement of the first and second outer portal frames.

15. The foldable and unfoldable structure of claim 13, further comprising a rigid covering coupled to at least one of the first and second outer portal frames.

16. The foldable and unfoldable structure of claim 13, further comprising a rack and pinion arrangement coupled between the central portal frame and the sliding portal frame and configured for moving the sliding portal frame between the lowered and raised positions.

* * * * *